United States Patent [19]

Chicckine

[11] 4,221,118

[45] Sep. 9, 1980

[54] HOLDER FOR EARRINGS

[76] Inventor: Sheila Chicckine, Old School, Glen Allan, R.R #2, Wallenstein, Canada

[21] Appl. No.: 872,904

[22] Filed: Jan. 27, 1978

[30] Foreign Application Priority Data

Jan. 11, 1977 [CA] Canada ..... 290022

[51] Int. Cl.[2] ..... A44C 7/00

[52] U.S. Cl. ..... 63/13

[58] Field of Search ..... 63/12, 13

[56] References Cited

U.S. PATENT DOCUMENTS 3,071,938 1/1963 Davidson ..... 63/13

FOREIGN PATENT DOCUMENTS 1221 of 1871 United Kingdom ..... 63/13

*Primary Examiner*—F. Barry Shay

*Attorney, Agent, or Firm*—Jerome P. Bloom, Co.,

[57] ABSTRACT

An earring holder for use with earrings of the pierced ear type includes a serpentine rod, with an enlarged spherical or drop-shaped outer end followed by a shallow U-shaped outer portion for holding an earring and a deeper inverted U-shaped inner portion, the bight of which rests in the passage through the pierced ear during use. No hook or stays are required to maintain the holder and earring in position, the holder being more or less balanced in the ear lobe and gently squeezing the lower portion of the ear lobe of the user.

1 Claim, 2 Drawing Figures

HOLDER FOR EARRINGS

This invention relates to an earring holder and in particular to an earring holder of the pierced ear type.

Presently available holders for earrings of the pierced ear type (hereinafter referred to as pierced earring holders) are two-piece, including a pin and an apertured stay. The pin is provided with an enlarged spherical outer end for limiting inward movement of the holder, and the stay is formed of spring metal for grasping the narrow inner end of the pin and preventing outward movement of the pin after insertion thereof through the ear and the stay. Moreover, the outer end of the pin or the sphere is provided with a loop for receiving the upper end of the earring, i.e. the earring is usually provided with a loop for hanging the earring from the holder.

Another type of presently available pierced earring holder is the so-called "Shepherds hook," which is similar to a safety pin including a loop passing through the ear lobe with one free end engageable with the other free end which passes beneath the ear lobe, terminating in a C-shaped loop.

It will readily be appreciated that the devices described above are relatively complicated and often uncomfortable in use. With the pin and stay type holder, the lobe of the ear must, in effect, be jammed or squeezed between the spherical outer end of the pin and the stay to prevent disengagement of the stay from the pin with resulting loss of the holder and earring. Whether in use or not, with a two-piece holder, the danger of loss of the earring and holder always exists. Moreover, use of the holder presents certain difficulties. The aperture in the stay positioned behind the ear lobe must be aligned with the pin, which is inserted through the ear from the outside.

The "Shepherds hook" type holder, like the two-piece holder, is difficult to install and may be uncomfortable, since the lobe may be pinched by the loop.

Accordingly, there exists a distinct need for a simple earring holder, preferably a one-piece holder, for use with earrings of the pierced ear type. The object of the present invention is to attempt to satisfy such need by providing a relatively simple pierced earring holder, which is easy to install, comfortable, and unlikely to become dislodged from the ear during use.

Figure 1:
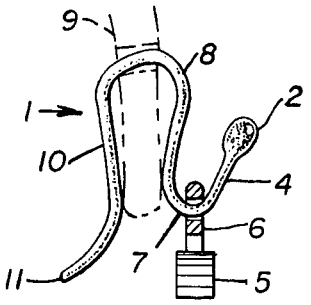
Figure 2:
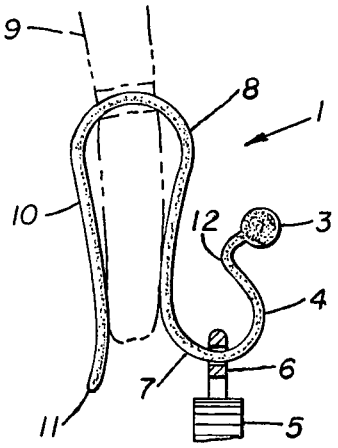

The invention will now be described in greater detail with reference to the accompanying drawings, which illustrates preferred embodiments of the invention, and wherein:

FIGS. 1 and 2 are enlarged elevation views of two embodiments of the invention in use.

With reference to the drawing, the pierced earring holder of the present invention is basically a serpentine wire or rod generally indicated at 1 with one enlarged end. In one embodiment (FIG. 1), the enlarged end is defined by a drop-shaped head 2 and, in the second embodiment, the enlarged end is defined by a spherical head 3. Of course the shape of the enlarged end or head of the rod is not of critical importance. It is preferable that such head be aesthetically pleasing.

With particular reference to FIG. 1, in use, the rod 1 slopes downwardly and inwardly from the head 2 defining a generally U-shaped outer portion 4 for supporting an earring 5 (a portion of which is shown schematically). The earring 5 is provided with a closed loop 6 at one end thereof, and the rod 1 is fed through the loop manually until the loop 6 is located at bight 7 of the U-shaped outer portion 4 of the holder. The head 2 obviously prevents dislodgement of the earring 5 from the holder.

The outer portion 4 of the holder is integral with, and followed by, a generally inverted U-shaped inner portion 8 which, in use, passes through an ear lobe 9 of the user. An interior arm 10 of the inner portion 8 is longer than the exterior arm of such inner portion extending downwardly beyond the bight 7 of the outer portion 4 of the holder. Inner free end of the arm 10 is slightly rounded and smooth because this part of the holder may bear against the jaw or neck of the person wearing the earring and holder.

Referring now to FIG. 2, the second embodiment of the invention is virtually identical to the first embodiment, except that the head 3 (as already mentioned) is spherical instead of drop-shaped, and the dimensions and curvatures of the outer and inner portions 4 and 8, respectively, are different. In the embodiment of FIG. 2, the outermost arm of the outer portion 4 is generally S-shaped with a sharp corner 12 near the head 3 impeding upward movement of the earring 5 during use. Moreover, the interior arm 10 of the inner portion 8 is straighter than the same arm in the embodiment of FIG. 1.

It will be appreciated that various modifications may be made to the curvature and length of the outer and inner portions 4 and 8 of the holder without departing from the spirit of the invention. It is readily apparent that the holder, in use, is approximately balanced in the ear lobe 9 of the user, being configured so the outer portion 4 is smaller than the inner portion 8 and so as to provide that the interior arm 10 of the inner portion 8 performs as a counterbalance to the outer portion 4 and the earring 5.

It will be noted that, in each embodiment of the invention, the top end or bight of the inner portion 8 is slightly wider than the bottom end, i.e. that portion of the inner portion at the level of the bottom end of the outer portion 4. Thus, while there is clearance between the top end of the inner portion and the ear lobe 9, the bottom end gently squeezes the ear lobe to help retain the holder and earring in one position.

I claim:

1. An ear ornament holder of the pierced ear type comprising a single serpentine rod, said rod having an integral form including a generally U-shaped outer portion providing a bight for holding an ear ornament, said outer portion having an extension forming with one side of said outer portion a generally inverted U-shaped inner portion adapted to be inserted through an ear lobe of a user of the holder for retention in connection therewith and to hold the applied ear ornament outwardly of the lobe, said inner portion providing that the sides thereof define inner and outer arms, the inner arm being longer than the outer arm and constructed and arranged to provide a counterbalance to the outer portion of the holder and an ear ornament applied thereto, said generally inverted U-shaped inner portion including generally opposed portions of said inner and outer arms of its U-shape which adjacent its open lower end are formed to be more closely adjacent each other than adjacent its closed upper end and are so constructed and arranged as to gently squeeze therebetween a lower portion of the ear lobe of the user of the holder to retain the holder and the applied ornament in a relatively established position with reference to and outwardly of the ear lobe.

* * * * *